United States Patent [19]

Sase

[11] Patent Number: 4,785,436

[45] Date of Patent: Nov. 15, 1988

[54] PHOTOVOLTAIC ELECTRONIC TIMEPIECE

[75] Inventor: Masahiro Sase, Sayama, Japan

[73] Assignee: Citizen Watch Co., Ltd., Tokyo, Japan

[21] Appl. No.: 13,755

[22] Filed: Feb. 12, 1987

[30] Foreign Application Priority Data

Feb. 14, 1986 [JP] Japan ..... 61-030466
Feb. 21, 1986 [JP] Japan ..... 61-037053

[51] Int. Cl.[4] ..... G04B 1/00
[52] U.S. Cl. ..... 368/205; 368/204
[58] Field of Search ..... 368/204, 205, 200–202

[56] References Cited

U.S. PATENT DOCUMENTS 4,129,981 12/1978 Nomura et al. ..... 368/204
4,173,756 11/1979 Kawagai et al. ..... 368/66
4,175,377 11/1979 Ichikawa ..... 368/66
4,219,999 9/1980 Ichikawa et al. ..... 368/80
4,280,208 7/1981 Nomura ..... 368/204
4,487,512 12/1984 Price ..... 368/66
4,540,292 9/1985 Rubenstein et al. ..... 368/82

*Primary Examiner*—Bernard Roskoski
*Attorney, Agent, or Firm*—Townsend & Townsend

[57] ABSTRACT

In an electronic timepiece powered by a photovoltaic cell, the supply voltage fluctuates a great deal due to the varying amounts of light received by the photovoltaic cell. This presents special considerations for a low voltage alarm circuit. The present invention combines two alarms. First, there is a charging alarm which responds to voltage and which indicates that voltage is low and that the amount of light should be increased. If the light is increased, the circuit will continue to operate and no reset operation is needed. If on the other hand the voltage drops to the point where the circuit actually stops, a stop alarm is activated. The stop alarm is not responsive to voltage level. Instead, it is responsive to the fact that the circuit's oscillator has stopped. Furthermore, the stop alarm is provided with a memory and it will not automatically be reset if the voltage is increased.

8 Claims, 13 Drawing Sheets

5
NORMAL STATE SIGNAL GENERATOR
FIRST MODULATED SIGNAL GENERATOR
SECOND MODULATED SIGNAL GENERATOR
FIRST SELECTOR
SECOND SELECTOR
DISPLAY DRIVER
SECOND FREQUENCY DIVIDER
FIRST FREQUENCY DIVIDER
TIME BASE SOURCE
VOLTAGE DETECTOR
VDD
VSS
P10
P11
P12
P15
P14
P6
P62
P61
P63
P81
P7
P8
P20
10
11
12
13
14
15
16
17
18
20
6
7
8
62
61
63
3
4
2
50

DISPLAY DRIVER
N R Z
SECOND SELECTOR
FIRST SELECTOR
NORMAL STATE SIGNAL GENERATOR
FIRST MODULATED SIGNAL GENERATOR
SECOND MODULATED SIGNAL GENERATOR
SECOND FREQUENCY DIVIDER
FIRST FREQUENCY DIVIDER
TIME BASE SOURCE
VOLTAGE DETECTOR
VDD
VSS

PHOTOVOLTAIC ELECTRONIC TIMEPIECE

BACKGROUND OF THE INVENTION

1. Field of the Invention

The present invention relates to an electronic timepiece which utilizes the photovoltaic voltage such as a solar cell as a power supply and, more particularly, to a photovoltaic electronic timepiece which performs an alarm display when timepiece information becomes incorrect due to reduction in a power supply voltage.

2. Description of the Prior Art

Conventionally, cells such as a mercury cell or a lithium cell are used as a power supply of an electronic timepiece, e.g., an electronic wrist watch. However, along with development of a capacitor with a large capacitance, a solar cell has been used as a power supply. In an electronic timepiece which utilizes a solar cell as a power supply, the photovoltaic voltage of the solar cell is stored in a capacitor, and a terminal voltage of the capacitor is used as a power supply. However, similar to an electronic timepiece which utilizes a cell as a power supply, there is a known electronic timepiece of this type which utilizes the photovoltaic voltage as a power supply, in which a normal time display is switched to a display different therefrom, i.e., a modulated display when a voltage of a storage battery (a power supply voltage) is reduced below a voltage level for causing the timepiece to perform the normal display so as to inform a user of need for charge (as disclosed in, e.g., U.S. Pat. No. 4,219,999).

However, in the electronic timepiece of this type, when a user does not notice the modulated display and keeps using the timepiece without charging it, the voltage of the capacitor is further reduced, and then generation of a time base signal by a quarter crystal oscillator is stopped. In this case, the user notices abnormality of the timepiece because a time display device is also stopped, resulting in no problem. However, when the timepiece is charged to return to a modulated display state or to a normal display state by charging after the time base signal is stopped and the user does not know this fact, the user uses the timepiece without knowing that the timepiece has lost time corresponding to time in which generation of the time base signal was stopped since the time display device is driven as usual to display time. In addition, in the case of an analog electronic timepiece, the above problem due to reduction of the power supply voltage occurs not only when the oscillator circuit is stopped but also when a pulse motor for driving hands is stopped and then returned to normal state or when generation of the time base signal is stopped due to a factor other than voltage reduction of the capacitor and then returned to normal state.

SUMMARY OF THE INVENTION

In order to eliminate the above problems, it is an object of the present invention to provide an electronic timepiece, which utilizes the photovoltaic voltage as a power supply, and which can perform an alarm display when time information goes wrong due to reduction in a power supply voltage.

DETAILED DESCRIPTION OF THE PREFERRED EMBODIMENTS

Figure 1A:
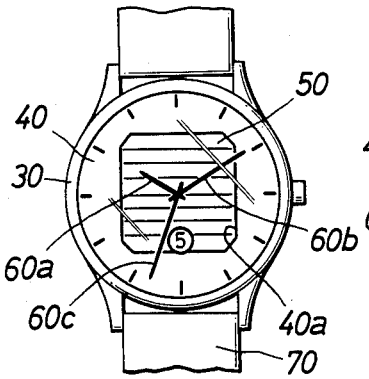
FIGS. 1A and 1B are plan views of two different forms of a solar cell electronic timepiece according to the present invention.
Figure 1B:
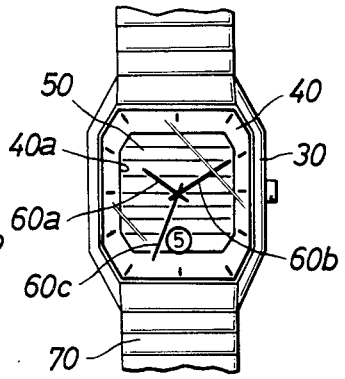

Referring to the accompanying drawings, FIGS. 1A and 1B are plan views of two different forms of a solar cell electronic timepiece as an example of an electronic timepiece according to the present invention, in which FIG. 1A shows an electronic timepiece having a circular face; and FIG. 1B, a square face. In FIGS. 1A and 1B, reference numeral 30 denotes a case; 40, a face disposed inside the case 30; 50, a solar cell unit exposed at a central opening 40*a* of the face 40; 60*a*, 60*b*, and 60*c*, hour, minute, and second hands, respectively; and 60, a band. A windshield is provided immediately above the face 40 and the hands 60*a*, 60*b*, and 60*c*. In the solar cell unit 50, a plurality of rectangular solar cell segments are arranged and electrically connected with each other so that output electromotive forces of the respective solar cell segments are added in series.

Figure 2:
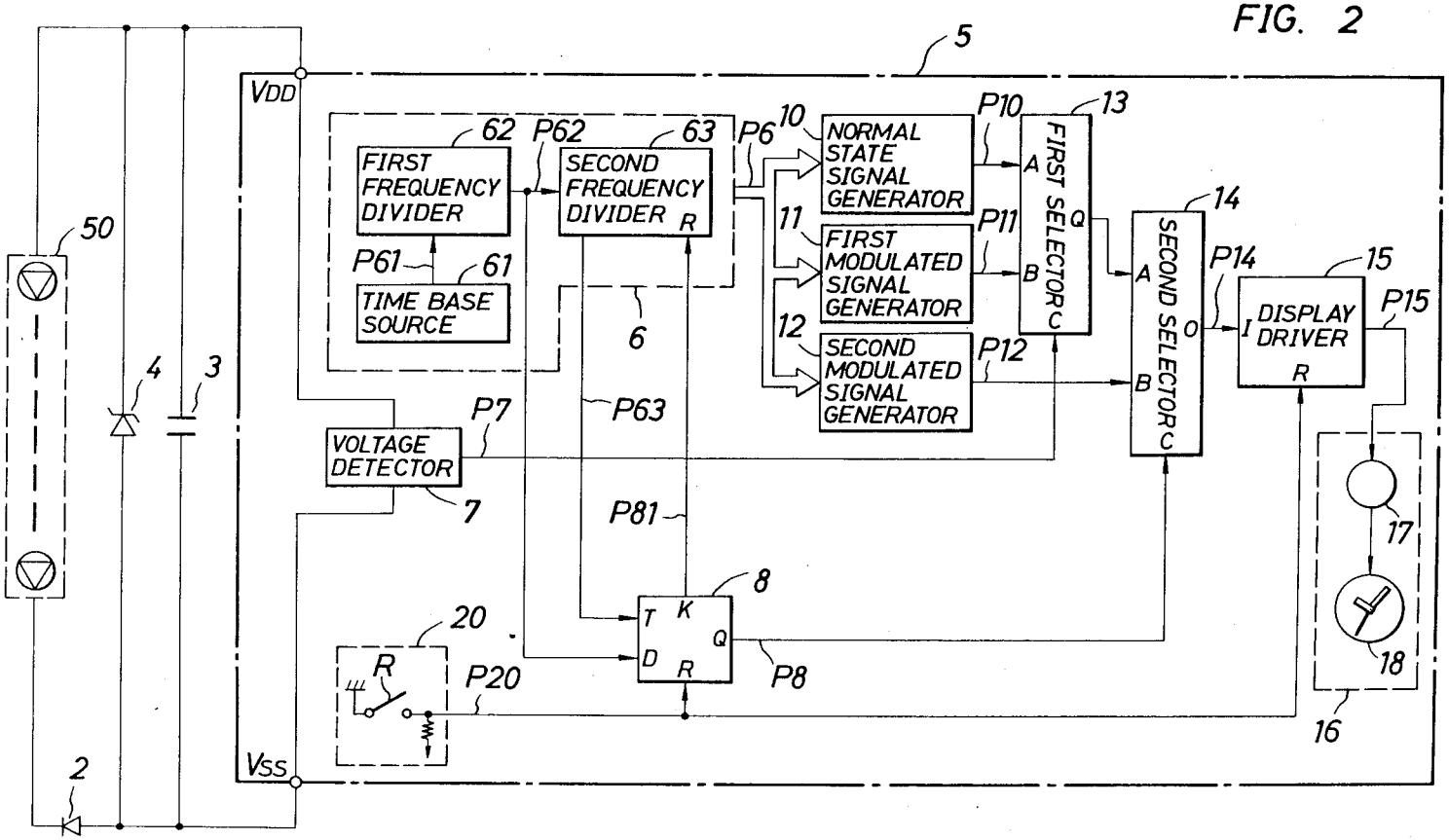
FIG. 2 is a block diagram of an embodiment of the solar cell electronic timepiece according to the present invention.

FIG. 2 is a block diagram of an embodiment of the solar cell electronic timepiece according to the present invention. An exemplified embodiment is an analog type, and when reduction in charged voltage of a capacitor is detected, a hand drive form is switched from normal drive as a normal display state to 2-second step drive as a modulated display state. When the user does not notice the 2-second step drive as the modulated display state indicating need for change and keeps using the timepiece, the voltage of the capacitor is further reduced and the time base signal of the reference signal generator is stopped. However, when the timepiece is charged from the reference signal stop state and returns to a voltage level by which the timepiece can operate again, a hand drive form is switched to an irregular 2-second step drive as a second modualted display state which indicates that the timepiece has lost time for a duration in which the time base signal of the reference signal generator was stopped. The irregular 2-second step drive as the second modulated display state is released by pulling a crown.

In FIG. 2, the solar cell unit 50 described above converts solar energy to electrical energy. Electric charge supplied by the solar cell unit 50 is charged to a capacitor 3 with a large capacitance through a diode 2 for preventing a reverse current. An overcharge preventing means 4 consisting of a zener diode 4 and the like controls the capacitor 3 such that its voltage does not exceed a withstand voltage. A timepiece device 5 is connected in parallel with the capacitor 3 so that the capacitor 3 serves as a power supply of the timepiece device 5.

An arrangement of the timepiece device 5 will now be described below. A reference signal generator 6 for generating a reference signal as a reference of time consists of a time base signal source 61, a first frequency divider 62, and a second frequency divider 63, and the time base source 61 generates a time base signal P61 (32768 Hz). The first frequency divider 62 consists of a plurality of stages of frequency dividers which receive the time base signal P61 from the time base source 61, and output a reference operation signal 62 as a reference signal of 512 Hz from the final stage. The second frequency divider 63 consists of a plurality of stages of frequency dividers which receive the reference operation signal P62 from the first frequency divider 62, output a predetermined reference signal P6 and then a memory timing signal P63 as a reference signal of ½ Hz when an input to an R terminal is at "L" level, and stop outputting the reference signal P6 and the memory timing signal P63 to be in a reset state when the input to the R terminal is at "H" level. The reset terminal R of the second frequency divider 63 is controlled by a stop detection signal 81 from a reference signal stop memory 8 to be described later.

A voltage detector 7 always detects a potential of the capacitor 3 and outputs a low voltage detection signal P7 of "H" level when it detects that the potential is reduced below the voltage level which enables the normal drive.

The reference signal memory 8 receives the reference operation signal P62 from the first frequency divider 62 at its input terminal D, the memory timing signal P63 from the second frequency divider 63 at its input terminal T, and a reset signal P20 from a switch circuit 20 to be described later at its reset input terminal R. The reference signal memory 8 outputs a stop detection signal P81 of "H" level at an ouput terminal K by detecting stop in accordance with the presenece or absence of input of the reference operation signal P62 to the input terminal D, and outputs a stop memory signal P8 of "H" level at an output terminal Q when it stores stop data in accordance with the timing of the memory timing signal P 63 input to the input terminal T. The stop memory signal P8 is reset from "H" to "L" level by the reset signal P20 supplied to the input terminal R from the switch circuit 20.

A normal state signal generator 10 outputs a drive pulse P10 for normal drive in accordance with a given reference signal P6 from the reference signal generator 6. A circuit arrangement of the normal state signal generator 10 will be exemplified in FIGS. 3 and 4.

The normal state signal generator 10 shown in FIG. 3 consists of 2-input NOR gates 10*a*, 10*b*, and 10*c* (to be referred to NORs 10*a*, 10*b*, and 10*c* hereinafter) receives a 1-Hz signal P615 (1 Hz) and a 128-Hz signal P608 (128 Hz) as the reference signal P6 from the reference signal generator 6, and outputs a drive pulse P10 for normal drive.

The 1-Hz signal P615 is input to the first input terminal of the NOR 10*a*, and the output terminal of the NOR 10*b* is connected to the second input terminal thereof. The output terminal of the NOR 10*a* is connected to the first input terminal of the NOR 10*b*, and the 128-Hz signal P608 is input to the second terminal thereof. The 1-Hz signal P615 is input to the first terminal of the NOR 10*c*, the output terminal on the NOR 10*a* is connect to the second input terminal thereof, and the drive pulse P10 is output from the output terminal of the NOR 10*c*. By connecting the three NOR gates as described above, a positive-going one-shot signal is output from the NOR 10*c* for a duration from the fall timing of a common input signal from "H" to "L" level of the NORs 10*a* and 10*c* until a latch circuit which consists of the NORs 10*a* and 10*b* is reset by rise of a second input signal of the NOR 10*b* to "H" level.

Figure 3:
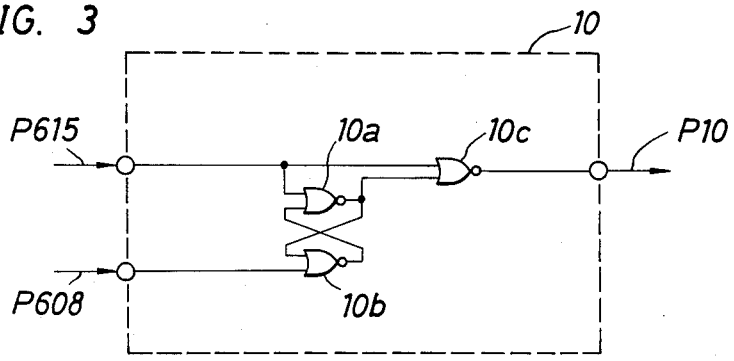
FIGS. 3 and 4 are circuit diagrams of two different arrangements of a normal state signal generator shown in FIG. 2.
Figure 4:
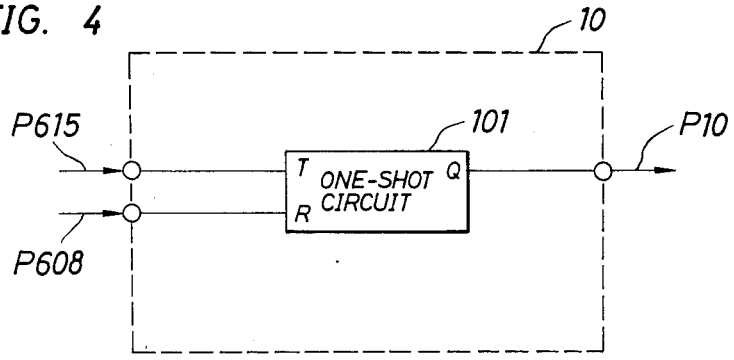

In the normal state signal generator 10 shown in FIG. 4, the circuit of the three NOR gates shown in FIG. 3 is constituted by a one-shot circuit 101. In the one-shot circuit 101, an input terminal T corresponds to a section where the common input signal of the NORs 10*a* and 10*c* is input in FIG. 3, an input terminal R corresponds to the second input terminal of the NOR 10*b* in FIG. 3, and an output terminal Q corresponds to the output terminal of the NOR 10*c* in FIG. 3. That is, the one-shot circuit 101 outputs, from the output terminal Q, a positive-going one-shot signal having a pulse width between the fall timing of the timing signal supplied to the input terminal T and rise of the reset signal supplied to the input terminal R.

A first modulated signal generator 11 outputs a 2-second step pulse P11 for 2-second step drive in accordance with a given reference signal P6 from the reference signal generator 6. A circuit arrangement of the first modulated signal generator 11 will be exemplified in FIG. 5.

The first modulated signal generator 11 consists of one-shot circuits 111 and 112, an inverter 113, a NAND gate (NAND) 114, and an OR gate (OR) 115. Generation of the 2-second step pulse P11 by the generator 11 will be explained with reference to a timing chart of FIG. 6. In the one-shot circuit 111, a pulse P111 having a width of 4 ms which is a half cycle of the 128-Hz signal P608 is formed in accordance with the fall timing of the ½ Hz signal (P616) from the reference signal generator 6.

The NAND 114 is provided to form timings t8 and t8′ which are fall timings of the NAND 114, and durations between t8 and t9 and between t8′ and t11 are 40 ms.

On the other hand, in the one-shot circuit 112, a pulse P112 having a width of 4 ms which is a half cycle of the 128-Hz signal P608 is formed in accordance with the fall timing of the NAND 112 which falls at timings t8 and t8′ every 2 seconds. By obtaining a logical sum of the pulses P111 and P112 by the OR 115, the 2-second step pulse P11 in which 2 positive-going pulses are output at the same time every 2 seconds is formed.

Figure 7:
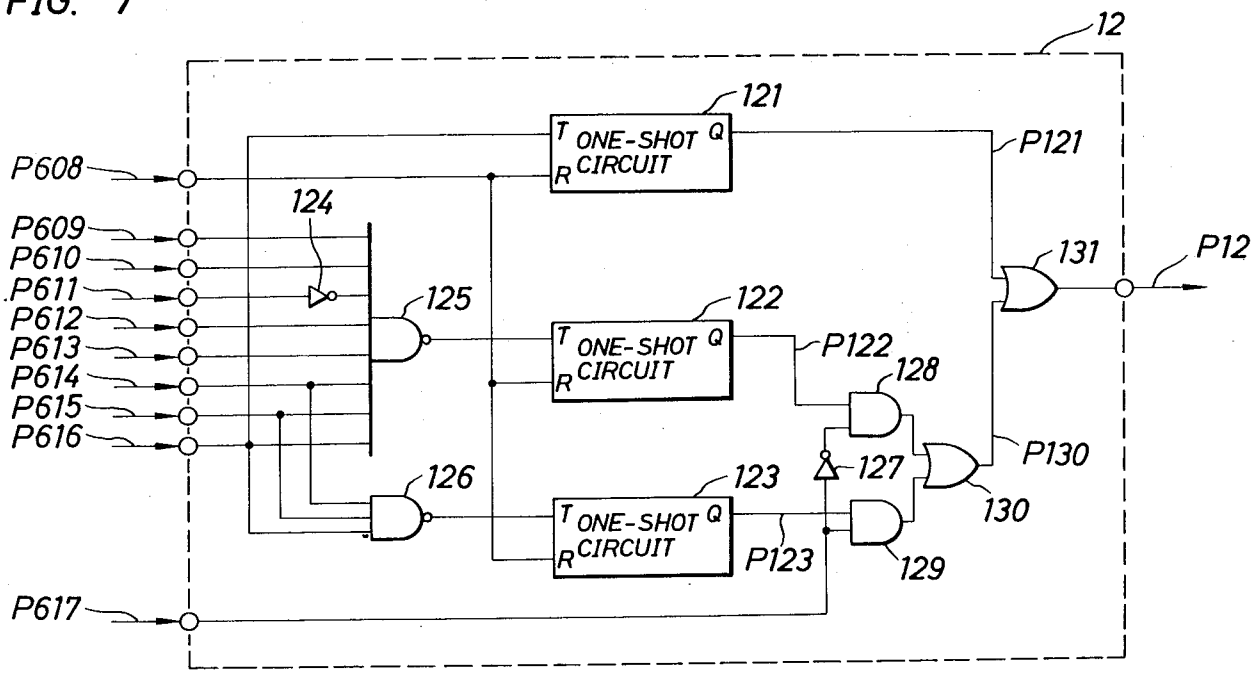
FIG. 7 is a circuit diagram of a second modulated signal generator shown in FIG. 2.

The second modulated signal generator 12 outputs an irregular 2-second step pulse P12 for irregular 2-second step drive as the second modulated display state in accordance with a given reference signal P6 of the reference signal generator 6. A circuit arrangement of the second modulated signal generator 12 will be exemplified with reference to FIG. 7.

The second modulated signal generator 12 consists of one-shot circuits 121, 122, and 123, inverters (INVs) 124 and 127, NAND gates (NANDs) 125 and 126, AND gates (ANDs) 128 and 129, or OR gates (ORs) 130 and 131.

Figure 5:
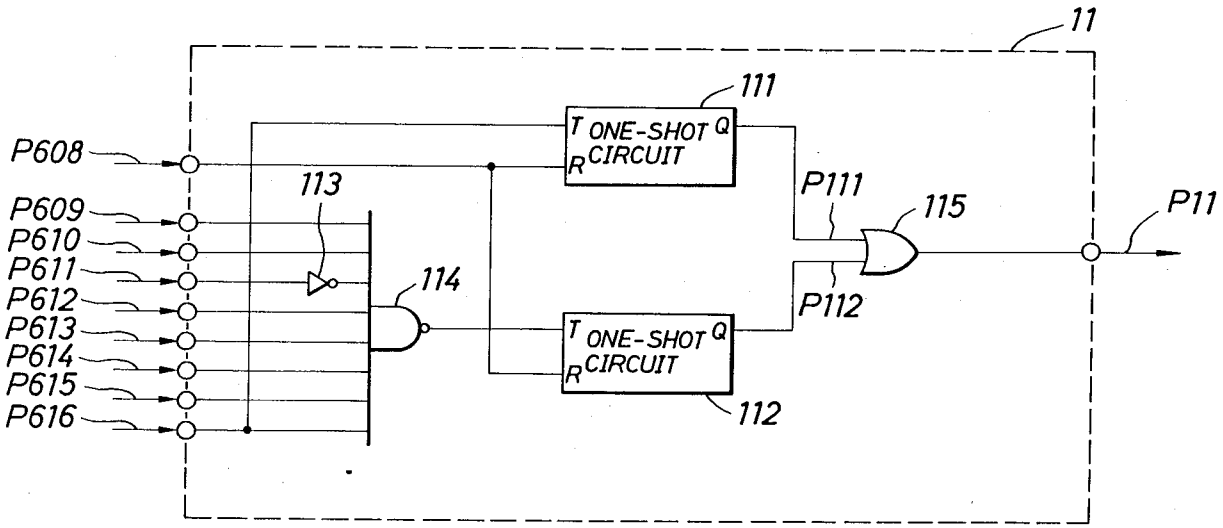
FIG. 5 is a circuit diagram of a first modulated signal generator shown in FIG. 2.

The one-shot circuits 121 and 122 constituting the generator 12 are the same as the one-shot circuits 111 and 112, respectively, of the first modulated signal generator 11 shown in FIG. 5, and the NAND 125 is the same as the NAND 124.

Figure 6:
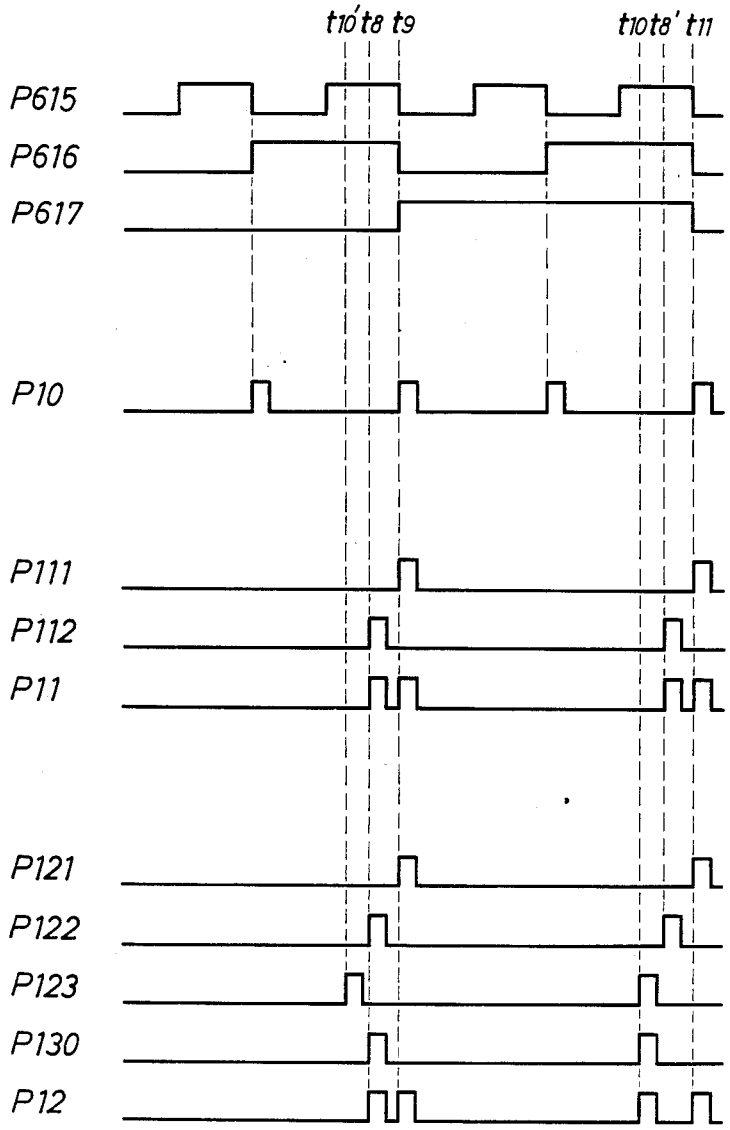
FIG. 6 is a timing chart showing an operation of a circuit shown in FIGS. 5 and 7.

Referring to FIG. 6, the NAND 126 is provided to form timings t10′ and t10 which are fall timings of an output signal of the NAND 126, and durations between t10′ and t9 and between t10 and t11 are 250 ms.

In the one-shot circuit 123, a pulse P123 having a width of 4 ms which is a half cycle of the 128-Hz signal is formed in accordance with the fall timing of the NAND 126 which falls at timings t10′ and t10 every 2 seconds. The INV 127, the ANDs 128 and 129, and the OR 130 constitute a selector circuit. As a pulse P130, the pulse 122 is selected when the ¼-Hz signal P617 is at "L" level, and the pulse P123 is selected when the ¼-Hz signal P617 is at "L" level.

By obtaining a logical sum of the pulses P121 and P130 by the OR 131, an irregular 2-second step pulse P12 in which 2 positive-going pulses are output at the same time every 2 seconds and the cycles of the 2 pulses are alternately changed is formed.

Referring again to FIG. 2, a first selector 13 is a selector in which an A input is selectively output when an input to a C terminal is at "L" level and a B input is selectively output when the input to the C terminal is at "H" level. The drive pulse P10 from the normal state signal generator 10 is input to the input terminal A of the first selector 13, and the 2-second step pulse P11 from the first modulated signal generator 11 is input to the input terminal B thereof. A control terminal C of the first selector 13 is controlled by the low voltage detection signal P7 from the voltage detector 7 to normally output the drive pulse P10, and when a low voltage state is detected, the 2-second step pulse P11 is selectively output therefrom.

The second selector 14 is a selector in which the A input is selectively output when an input to a C terminal is at "L" level and a B input is selectively output when the input to the C terminal is at "H" level. The selected output signal from the first selector 13 is input to an input terminal A of the second selector 14, and the irregular 2-second step pulse P12 from the second modulated signal generator 12 is input to the input terminal B thereof. The control terminal C is controlled by a stop memory signal P8 from a reference signal stop memory 8 to be described later to output a selected output signal P14.

On the other hand, the switch circuit 20 is operated by pulling or depressing a crown and outputs a reset signal P20 when the crown is pulled. A display driver 15 outputs an input signal to a terminal I as a drive signal P15 when an input to an R terminal is at "L" level, and stops outputting the drive signal P15 when the input to the R terminal is at "H" level. The selected output signal P14 is input to the input terminal I of the display driver 15 from the second selector 14, and the reset terminal R is controlled by the reset signal P20 from the switch circuit 20. That is, output of the drive signal P15 is stopped when the crown is pulled, and the selected output signal from the second selector 14 is output as the drive signal P15 when the crown is depressed to drive pulse motor 17 of a time display device 16, so that a hand display operation is performed by a hand display device 18 which is interlocked with the pulse motor 17.

A situation in which the potential of the capacitor 3 serving as a power supply of the solar cell is reduced will be described below.

The voltage detector 7 which normally detects the potential of the capacitor 3 outputs the low voltage detection signal P7 when it detects that the potential is reduced below the voltage level which enables the normal drive. In accordance with control of the low voltage detection signal P7, the selected output of the first selector 13 is switched from the drive pulse P10 to the 2-second step pulse P11. That is, the hand operation of the hand display device is switched from the 1-second hand operation as normal drive to the 2-second hand operation which indicates reduction in the charged voltage. Thereafter, when the voltage detector 7 detects that the potential of the capacitor 3 returns to the voltage level which enables normal drive by charge by the solar cell unit 50, the low voltage detection signal P7 returns to "L" level. Then, the first selector 13 selects the drive pulse P1. That is, the hand operation of the hand display device 18 returns from the 2-second hand operation to 1-second hand operation. In addition, when the crown is pulled while it is normally depressed, the switch 20 outputs the reset signal P20 of "H" level. The display driver 15 stops outputting the drive signal P15 by control of the reset signal P20, and the hand display device 18 also stops operation.

An alarm display operation indicating that time delay has occurred when the reference signal generator 6 is stopped because the potential of the capacitor 3 is reduced below the level at which the voltage detector 7 outputs the voltage detection signal P7 and then the capacitor is charged to increase the potential will be described below. However, an arrangement and an operation of the reference signal stop memory 8 which plays an important role in the above function will be described first.

Figure 8:
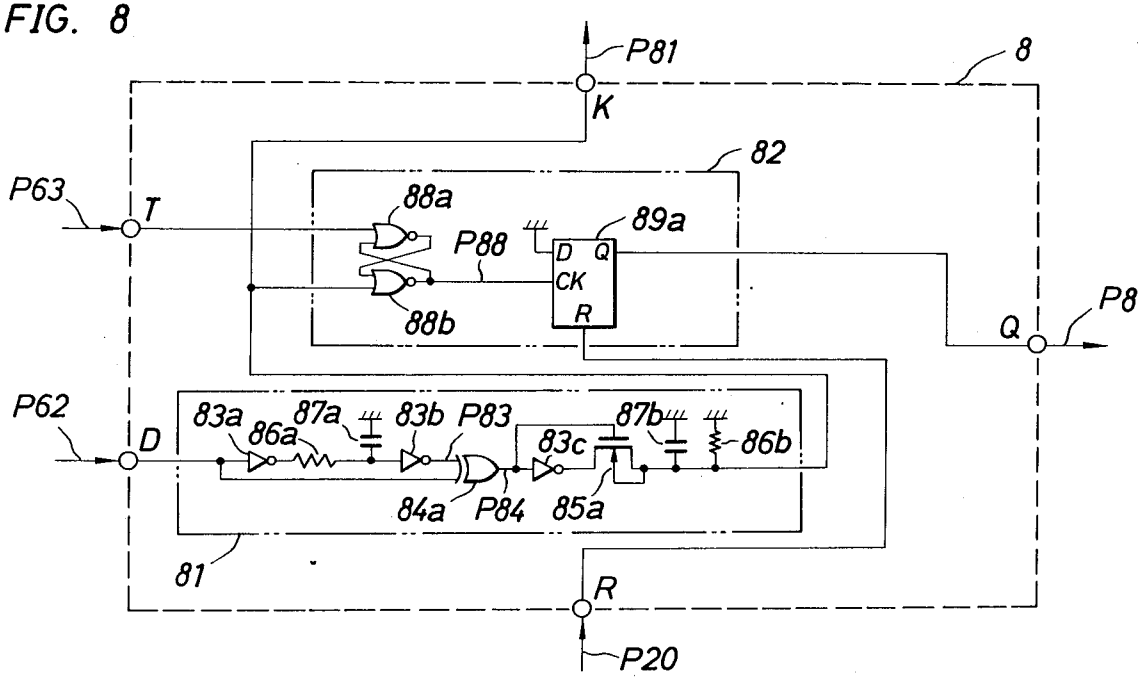
FIG. 8 is a circuit diagram of a stop memory circuit shown in FIG. 2.

FIG. 8 shows an example of a circuit arrangement of the reference signal stop memory 8.

The reference signal stop memory 8 consists of a stop detection section 81 for outputting the stop memory signal P81 and a memory section 82 for outputting the stop memory signal P8.

The stop detection section 81 consists of INVs 83*a* to 83*c*, an exclusive logic gate 84*a* (to be referred to as an EXOR 84*a*), an NchCMOS transistor 85*a* (to be referred to as a CMOS Tr 85*a*), capacitors 87*a* and 87*b*, and resistors 86*a* and 86*b*.

The input terminal of the INV 83*a* is connected to the input terminal D and hence receives the reference operation signal P62 from the first frequency divider 62. The output terminal of the INV 83*a* is connected to the input terminal of the INV 83*b* through an integral circuit consisting of the resistor 86*a* and the capacitor 87*a*. As a result, a delay signal P83, which is delayed with respect to the reference operation signal P62 by a duration of delay time of the integral circuit consisting of the resistor 86*a* and the capacitor 87*a*, is output from the output terminal of the INV 83*b*. One input terminal of the EXOR 84*a* is connected to the output terminal of the INV 83*b* and hence receives the delay signal P83, and the other input terminal thereof is connected to the input terminal D and hence receives the reference operation signal P62 from the first frequency divider 62. The output terminal of the EXOR 84*a* is connected to the input terminal of the INV 83*c* and to a gate input terminal of the CMOS·Tr 85*a*. As a result, a glitch signal P84 as a time difference between the reference operation signal P62 and the delay signal P83 is output from the output terminal of the EXOR 84*a*. The output terminal of the INV 83*c* is connected to a source input terminal of the CMOS·Tr 85*a*. In addition, a bulk of the CMOS·Tr 85*a* is common with a drain output terminal thereof, and the drain output terminal outputs the stop detection signal P81 through a charge pump circuit consisting of the capacitor 87*b* and the resistor 86*b*. The stop detection signal P81 is output from the output terminal K of the reference signal stop memory 8.

The memory section 82 consists of 2-input NOR gates 88*a* and 88*b* (to be referred to as NORs 88*a* and 88*b*) and a data type flip-flop 89*a* (to be referred to as a D-FF 89*a*).

The NORs 88*a* and 88*b* are of a latch circuit arrangement, one input terminal of the NOR 88*a* serving as a set input terminal of the latch circuit is connected to the input terminal T and hence receives the memory timing signal P63, and one input terminal of the NOR 88*b* serving as a reset input terminal of the latch circuit receives the stop detection signal P81. A latch signal P88 is output from the output terminal of the NOR 88*b* as an output terminal of the latch circuit. An input terminal R of the D-FF 89*a* is connected to the input terminal R of the stop memory circuit 8 and hence receives the reset signal P20 from the reset circuit 20. The output terminal of the NOR 88*b* as an output terminal of the latch circuit is connected to an input terminal CK of the D-FF 89*a*. The input terminal D of the D-FF 89*a* is connected to a power supply terminal VDD and hence is always at "H" level, reads data ("H" level of the power supply terminal VDD in this case) of the input terminal D by a rise of the signal supplied to the input terminal CK, and outputs the stop memory signal P8 of the "H" level at an output terminal Q. The stop memory signal P8 is output at the output terminal Q of the stop memory circuit 8.

An operation of the reference signal stop memory circuit 8 will be described with referring to FIG. 9.

Figure 9:
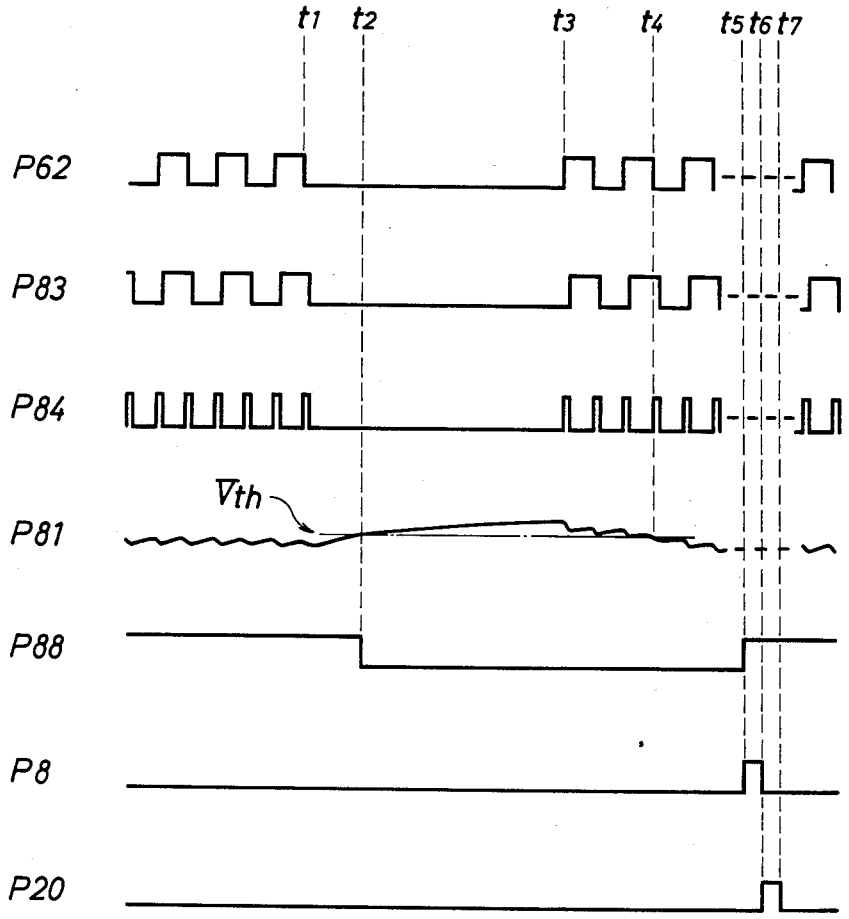
FIG. 9 is a timing chart showing an operation of the stop memory circuit shown in FIG. 8.

In FIG. 9, the reference signal generator 6 normally operates and outputs the reference operation signal P62 of 512 Hz until timing t1. Between timings t1 to t3, the reference signal P62 is stopped due to extreme reduction in charged voltage of the capacitor 3 or the like. After timing t3, the reference signal generator 6 operates normally again and outputs the reference operation signal P62 of 512 Hz due to increase in charged voltage of the capacitor 3 or the like.

First, an operation until timing t1 will be described below. Since the reference operation signal P62 is input, a signal delayed by duration of delay time of the integral circuit consisting of the resistor 86*a* and the capacitor 87*a* is output as the delay signal P83, and the glitch signal P84 outputs a signal having a positive-going glitch corresponding to a time difference between the reference operation signal P62 and the delay signal P83. As a result, the output of the INV 83*c* becomes a negative-going glitch signal. Since the capacitor 87*b* maintains a charge state by control of the CMOS·Tr 85*a*, the reference signal generator 6 outputs the stop detection signal P81 of "L" level which indicates the normal operation.

An operation between timings t1 and t3 will be described below. Since the reference signal generator 6 is stopped to stop the reference operation signal P62 from the timing t1, the delay signal P83 and the reference operation signal P62 are always stopped at the same level, and the glitch signal P84 is fixed at "L" level. As a result, charging of the capacitor 87*b* controlled by the INV 83*c* and the CMOS·Tr 85*a* is no longer performed, and an electric charge which is charged to the capacitor 87*b* is discharged through the resistor 86*b*, thereby increasing a level of the stop detection signal P81. The level of the stop detection signal P81 then extends a logical Vth. At this timing, the timing t2, stop of the reference signal generator 6 is detected. The latch signal P88 is switched from "H" to "L" level at the timing t2. In addition, by the stop detection signal P81 of "H" level from the timing t2, the stages of the second frequency divider 63 are in a reset state, i.e., the count is zero, so that the frequency dividing operation is stopped.

An operation after the timing t3 will be described below. When the reference operation signal P62 is again input, the signal delayed with respect to the reference operation signal P62 by duration of delay time of the integral circuit consisting of the resistor 86*a* and the capacitor 87*a* is output as the delay signal P83, and the glitch signal P84 begins to output the signal having a positive-going glitch corresonding to a time difference betwen the reference operation signal P62 and the delay signal P83. The output signal of the INV 83*c* becomes a negative-going glitch signal, and the capacitor 87*b* is charged again by control of the CMOS·Tr 85*a*. As a result, the level of the stop detection signal P81 is reduced and finally becomes below the logical Vth. At this timing, the timing t4, the normal operation of the reference signal generator 6 is again detected. The stop detection signal P81 is switched from "H" to "L" level at the timing t4, so that the reset state of the second frequency divider 63 is released, the frequency dividing operation is started again, and the stages start counting. About one second after the second frequency divider 63 starts counting from the timing t4, the memory timing signal P63 is switched from "L" to "H" level, and the latch signal P88 is set to be switched from "L" to "H" level. The D-FF 89*a* reads the "H" level by a rise of the signal supplied to the input terminal Ck, and the stop memory signal P8 is switched from "L" to "H" level. At this timing, the timing t5, stop of the reference signal generator 6 is stored. When the crown is pulled at the timing t6, the reset signal P20 from the switch circuit 20 is switched from "L" to "H" level, the D-FF 89*a* is reset, and the stop memory signal P8 is switched from "H" to "L" level. That is, the memory data of stop of the reference signal generator 6 is released at the timing t6. When the crown is depressed at the timing t7, the reset signal P20 from the switch circuit 20 is switched from "H" to "L" level, and the stop memory 8 detects stop of the reference signal generator 6 again and returns to an initial state capable of storing data.

The operation of the overall analog electronic timepiece will be described below with reference to FIG. 10.

Figure 10:
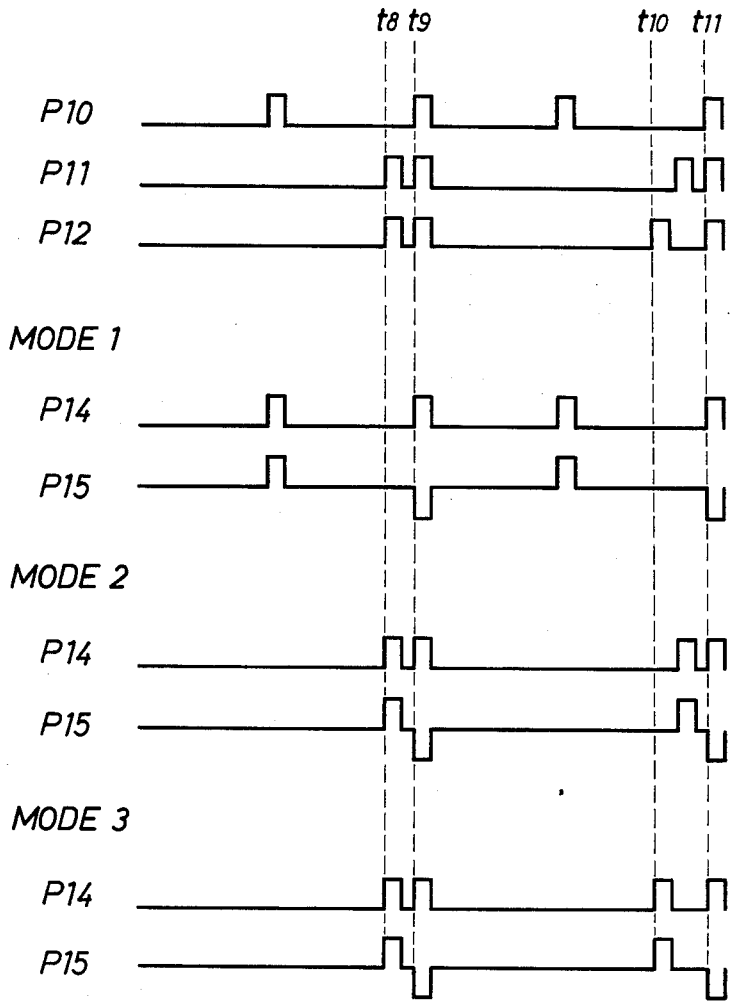
FIG. 10 is a timing chart showing voltage waveforms at essential parts of the embodiment in FIG. 2.

FIG. 10 shows voltage waveforms of a drive pulse P10 of the normal state signal generator 10, a 2-second step pulse P11 of the first modulated signal generator 11, and an irregular 2-second step pulse P12 of the second modulated signal generator 12. In this embodiment, a duration between timings t8 and t9 is 40 ms, and t10 and t11, 250 ms, in FIG. 10.

MODE 1 (normal display state)

First, mode 1 in FIG. 10, normal drive as a normal display state will be described. In this state, the crown is naturally depressed, the reference signal generator 6 outputs the reference operation signal P62, and the potential of the capacitor is at a voltage level capable of normal drive or more. Therefore, the stop memory signal P8 from the stop memory 8 is at "L" level, and as a result of detecting the potential of the capacitor 3 by the voltage detector 7, the low voltage detection signal P7 is at "L" level. As a result, the drive pulse P10 is selectively output from the first selector 13 and is also selectively output as the selected output signal P14 from the second selector 14. Also, a voltage waveform shown in mode 1 of FIG. 10 is output as the drive signal 15 from the display driver 15 because the reset signal P20 is at "L" level. The pulse motor 17 is driven in accordance with the drive signal P15, and the hand display device 18 which is interlocked with the pulse motor 17 is normally driven (1-second step drive), i.e., is in the normal display state.

MODE 2 (first modulated state)

Mode 2 in FIG. 10, a 2-second step operation as a first modulated display state will be described. In this state, the crown is naturally depressed, and the reference signal generator 6 outputs the reference operation signal P62, but the potential of the capacitor 3 is below the voltage level capable of normal drive. Therefore, the stop memory signal from the stop memory 8 is at "L" level, and as a result of detecting the potential of the capacitor 3 by the voltage detector 7, the low voltage detection signal P7 is at "H" level. As a result, the 2-second step pulse P11 is selectively output from the first selector 13 and is also selectively output as the selected output signal P14 from the second selector 14. A voltage waveform shown in mode 2 of FIG. 10 is output as the drive signal P15 from the display driver 15 because the reset signal P20 is at "L" level. The pulse motor 17 is driven in accordance with the drive signal P15, and the hand display device 18 which is interlocked with the pulse motor 17 is 2-second-step-driven, i.e., is in the first modulated display state in which the second hand is driven 2 steps at a time every 2 seconds.

MODE 3 (second modulated state)

Mode 3 in FIG. 10, irregular 2-second step drive as a second modulated state will be described. In this state, the crown is naturally depressed, the capacitor 3 is charged from the reference signal stop state due to extreme voltage reduction or the like and returns to the voltage level at which the timepiece starts to drive again. Therefore, the stop memory signal P8 from the stop memory 8 is at "H" level. Then, regardless of whether the potential of the capacitor 3 is over or below the voltage level capable of normal drive, the irregular 2-second step pulse P12 is output as the selected output signal P14 from the second selector 14. Since the reset signal P20 is at "L" level, a voltage waveform shown in mode 3 of FIG. 10 is output as the drive signal P15 from the display driver 15. The pulse motor 17 is driven in accordance with the drive signal P15, and the hand display device 18 is irregular-2-second-step-driven, i.e., is in the second modulated display state in which the second hand is driven 2 steps at a time every 2 seconds and a cycle of 2-second step drive is alternately changed.

Mode 3 in FIG. 10 is a state between timings t5 to t6 in FIG. 9. In FIG. 9, when the crown is pulled at the timing t6, the reset signal P20 of the switch circuit 20 is switched from "L" to "H" level, and the stop memory signal P8 is switched from "H" to "L" level, so that the memory data of stop of the reference signal generator 6 is released. In addition, in the state between timings t6 to t7 in which the crown is pulled while it is depressed in the normal state, the display driver 15 is stopped to output the drive signal P15 by control of the reset signal P20, and a hand display operation of the hand display device 18 is also stopped. After the crown is depressed at the timing t7 in FIG. 9, the irregular 2-second step drive as the second display state is released. Normal drive (1-second step drive) as the normal display state of mode 1 in FIG. 10 is performed when the low voltage detection signal P7 is at "L" level, and the 2-second step drive as the first modulated display state of mode 2 in FIG. 10 is performed when the low voltage detection signal P7 is at "H" level.

Figure 11:
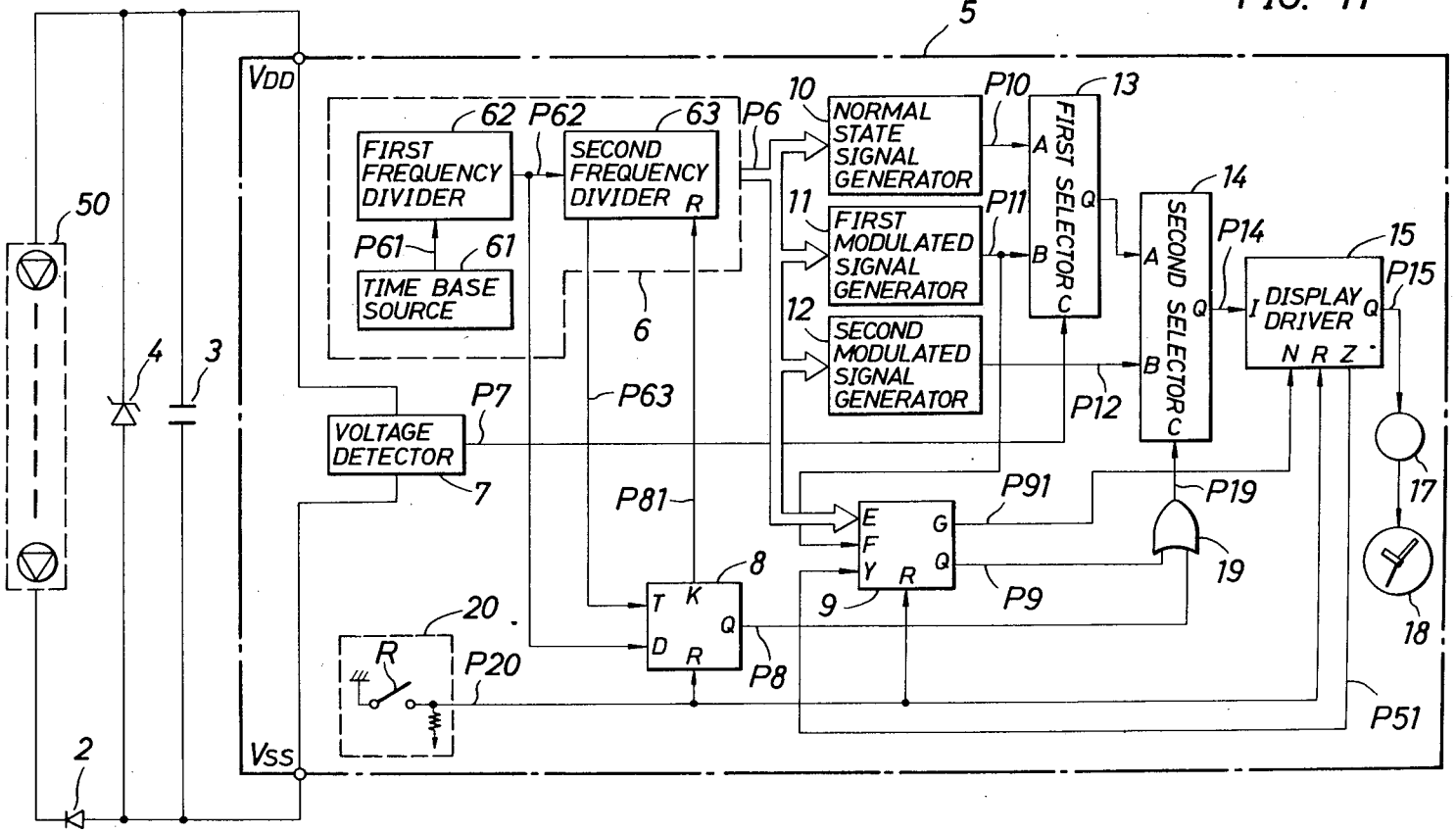
FIG. 11 is a block diagram of another embodiment of the solar cell electronic timepiece according to the present invention.

As is apparent from the above description, when reduction in charged voltage of the capacitor 3 is detected, a drive form is switched from normal drive (1-second step drive) as the normal display state to 2-second step drive as the first modulated display state in which the second hand is driven 2 steps at a time every 2 seconds to inform the user of need for charge. When the capacitor 3 is charged from the reference signal stop state in which the reference signal P6 of the reference signal generator 6 is stopped and the timepiece starts to be driven again, a drive form is switched to the irregular 2-second step drive as the second modulated display state in which the second hand is driven 2 steps at a time every 2 seconds and a cycle of 2-step drive is alternately changed so as to indicate that the timepiece has lost time by a duration in which the reference signal P6 of the reference signal generator 6 is stopped. Thereafter, the irregular 2-second step drive is released by pulling the crown. When the voltage is reduced, the pulse motor sometimes stops under the condition in which the reference signal is stopped. Therefore, even if the reference signal is not stopped, the timepiece may lose time by a duration in which the pulse motor is stopped, thus posing the same problem as in the case of stop of the reference signal. FIG. 11 is a block diagram of another embodiment of the solar cell electronic timepiece for solving the above problem.

An arrangement of this embodiment is very similar to that of the embodiment shown in FIG. 2 except that a pulse motor stop memory 9 for detecting and storing stop of the pulse motor is provided and that a second modulated signal is selected in accordance with operation signals of a reference signal stop memory 8 and the pulse motor stop memory 9 and is supplied to a motor drive circuit.

the pulse motor stop memory 9 forms, in accordance with a reference signal P6 to an input terminal E, a strobe signal P91 for extracting at a predetermined timing an induced voltage generated at a coil of a pulse motor 11 and outputs it from an ouput terminal G. The pulse motor stop memory 9 determines whether the motor is rotated in accordance with a 2-second step pulse P11 supplied from the first modulated signal generator 11 to an input terminal F and an induced voltage signal P51 (to be described later) supplied to an input terminal Y. When the pulse motor stop memory 9 detects that a pulse motor 17 is not rotated, i.e., stopped, it stores it and outputs the pulse motor stop memory signal P9 of "H" level from an output terminal Q. A reset signal P20 from a switch circuit 20 is input to an input terminal R, and a pulse motor stop memory P9 is reset from "H" to "L" level in accordance with the reset signal P20 of "H" level.

Reference numeral 19 denotes a 2-input OR gate (to be referred to as an OR hereinafter). The reference stop memory signal P8 from the reference signal stop memory 8 is input to one input terminal of the OR 19, the pulse motor stop memory signal P9 from the pulse motor stop memory 9 is input to the other input terminal, and a stop memory signal P19 is output from an output terminal.

Figure 12:
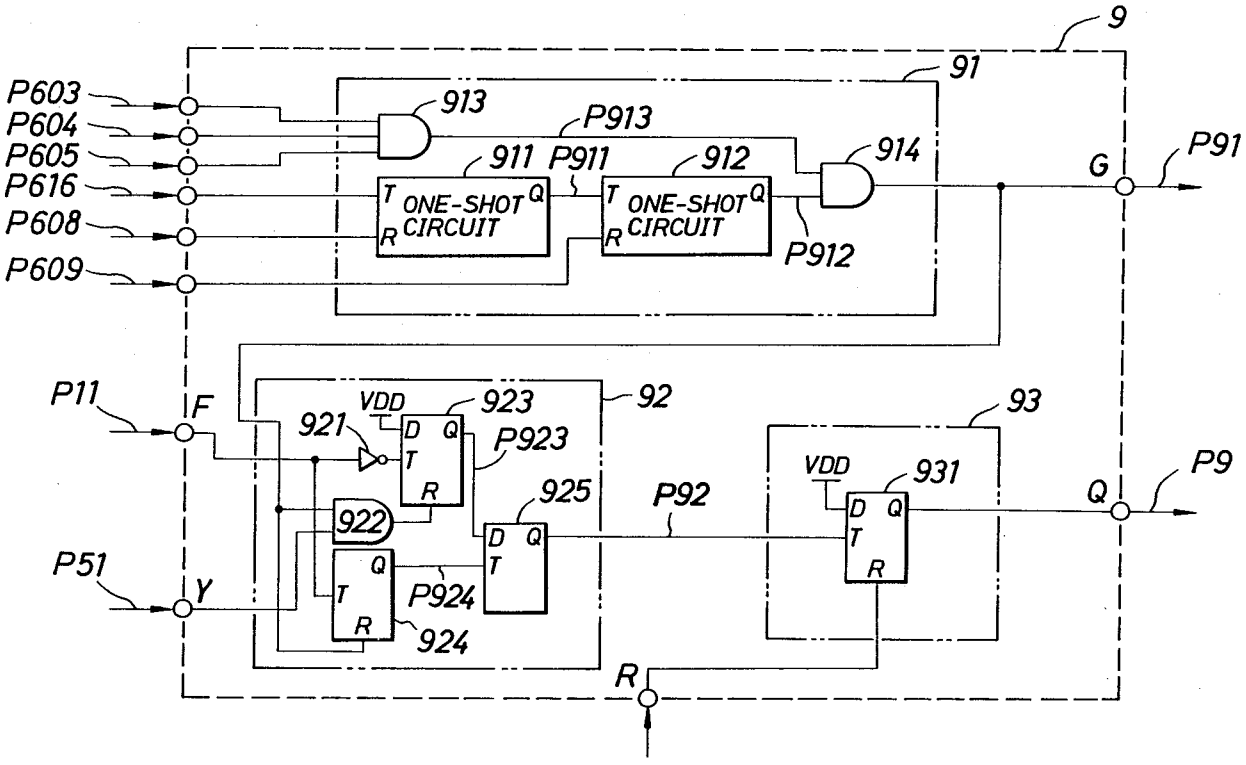
FIG. 12 is a circuit diagram of a pulse motor stop memory circuit shown in FIG. 11.

FIG. 12 exemplifies a circuit arrangement of the pulse motor stop memory 9 which consists of a strobe signal formation section 91, a pulse motor stop detection section 92, and a pulse motor stop memory section 93.

Figure 13:
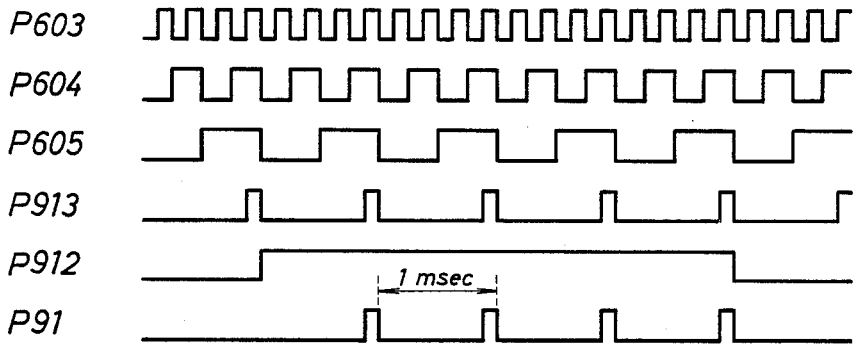
FIG. 13 is a timing chart of signals supplied to the pulse motor stop memory circuit shown in FIG. 12.

A circuit operation will be described with reference to a waveform shown in FIG. 12. The strobe signal formation section 91 consists of one-shot circuits 911 and 912 and AND gates (AND) 913 and 014. P608 (128 Hz) and P616 (½ Hz) are input to the one-shot circuit 911, P609 (64 Hz) is input to the one-shot circuit 912, and P603, P604, and P605 as shown in FIG. 13 are input to the AND 913. As a result, in the one-shot circuit 911, a pules P911 having a width of 4 ms which is a half cycle of P608 is formed in accordance with a rise timing of P616. In the one-shot circuit 912, a pulse P912 as a permission timing is formed, in accordance with a fall timing of the pulse P911, at which the strobe signal having a width of 4 ms which is obtained by subtracting a half cycle of P608 from a half cycle of P609 is output. In the AND 914, by obtaining a logical product of an output signal (chopper signal) of the AND 913 and the pulse P912, a strobe signal (P91) with 4 strobes is formed every 2 seconds at a timing immediately after a positive-going pulse at a common timing of P10, P11, and P12.

The pulse motor stop detection section 92 is constituted by an inverter 921, an AND gate 922, data type flip-flops 923 and 925 which are operated in accordance with the rise signal supplied to T input terminals, and a toggle type flip-flop 924 supplied to the T input terminal. P924 is at "L" level since the strobe signal formed by the strobe signal formation section 91 is supplied to an R input terminal of the flip-flop 924. The pulse P924 rises from "L" to "H" level at the rise timing of the next 2-second step pulse P11, and then falls from "H" to "L" level at the fall timing of the still next 20-second step pulse P11. This is repeated every 2 seconds. The flip-flop 925 performs a final detection of stop of the pulse motor in such a manner that it determines that the pulse motor rotates when P923 as an output signal of the flip-flop 923 is at "L" level and determines that the pulse motor stops when P923 is at "H" level. The data type flip-flop 923 reads "H" level at the fall timing of the 2-second step pulse P11 and is reset from "H" to "L" level in accordance with the induced voltage signal P51 from the display drive 15. The relationship between the drive pulse and the pulse motor 17 is designed so that it can be determined that the pulse motor 17 rotates when the induced voltage signal P51 is present at at least 1 of 4 strobe timings of the strobe signal P91 and it can be determined that the pulse motor 17 stops when the induced voltage signal P51 is not present at any of 4 strobe timings. The pulse motor stop memory section 93 consists of a data type flip-flop 931, detects that the motor does not rotate, i.e., stops, in accordance with the pulse motor stop detection signal P92 and stores it, and outputs a pulse motor stop memory signal P9 of "H" level. The pulse motor stop memory signal P9 is output from the output terminal Q of the pulse motor stop memory 9. The pulse motor stop memory section 93 is connected to the input terminal R of the pulse motor stop memory 9 and hence receives the reset signal P20 from the switch circuit 20, and the pulse motor stop memory signal P9 is reset from "H" to "L" level in accordance with the reset signal P20 of "H" level.

An operation of the above embodiment will now be described below. However, the time display operation when the power supply voltage is normal and the first modulated display (2-second step) and the second modulated display (irregular 2-second step) according to stop of reference signal when the power supply voltage is reduced are the same as in the first embodiment. Therefore, only first and second modulated displays due to stop of a pulse motor which is a characteristic feature of the second embodiment will be described with reference to FIGS. 14B and 14C.

Figure 14A:
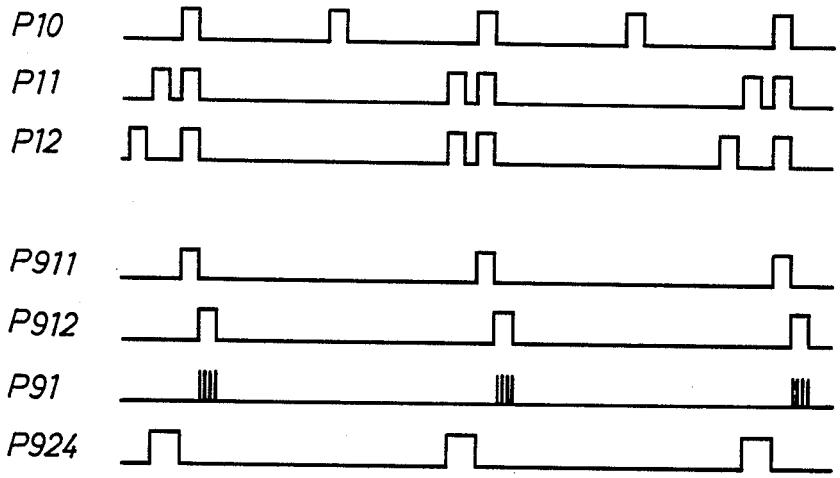
FIGS. 14A, 14B, and 14C are timing charts showing an operation of the pulse motor stop memory circuit shown in FIG. 12.
Figure 14B:
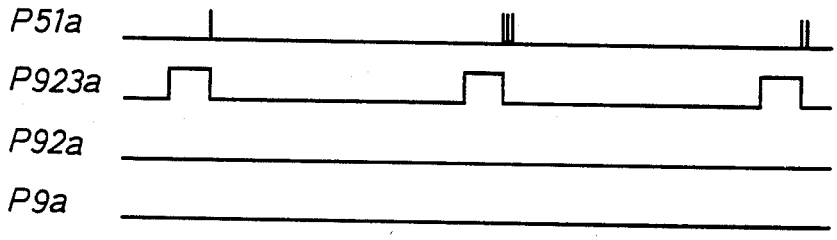
Figure 14C:
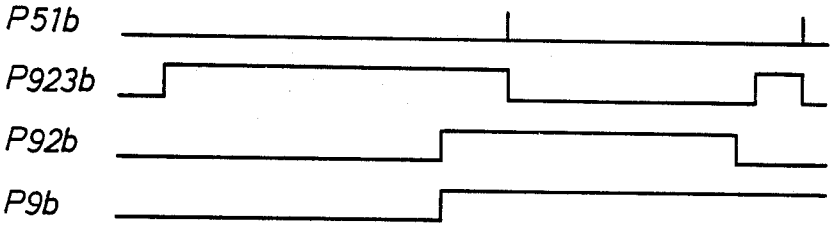

FIG. 14B shows a case in which the pulse motor rotates, and FIG. 14C shows a case in which stop of the pulse motor is detected. When the pulse motor 17 keeps rotating, P923*a* is always reset in accordance with the timing of P51*a* before the rise timing of P924, the pulse motor stop detection signal P92*a* does not rise, and hence the pulse motor stop memory signal P9*a* remains at "L" level. On the contrary, in a first detection operation when stop of the pulse motor 17 is stored, P923*b*, is not reset since the induced voltage signal P516 is not present at any of 4 strobe timings. At the next rise timing of P924, the pulse motor stop detection signal P92*b* reads "H" level and rises to detect stop of the pulse motor, and the pulse motor stop memory signal P9*b* rises to store stop of the pulse motor. At the next detection operation, the pulse motor stop detection signal P92*b* returns to "L" level if the induced voltage signal P51*b* is present. However, the pulse motor stop memory signal P9*b* does not return to "L" level and the stop memory of the pulse motor is not released unless the crown is pulled and the reset signal P20 is output from the switch circuit 20.

When stop of the pulse motor is stored in FIG. 14C, when the power supply voltage of the pulse motor 17 is around the stop voltage, stop and rotation sometimes alternate in such a manner that stop is detected in the first detection operation, rotation in the next detection operation, and again rotation in the still next detection operation.

In this embodiment, two stop memories, i.e., the reference signal stop memory 8 and the pulse motor stop memory 9 are provided. This is because a difference is generally present between stop voltages of the reference signal generator 6 and the pulse motor 17, and the stop voltage of the reference signal generator 6 is higher than that of the pulse motor 17. That is, when the user does not notice 2-second step drive as the first modulated display state and keeps using the timepiece without charging it to reduce voltage of the capacitor 3, the pulse motor 17 sometimes stops before the reference signal generator 6 stops, resulting in display of wrong time by the hand display device 18. When the timepiece is charged from this state, no alarm device is performed since the timepiece has returned to the normal operation before the reference signal generator 6 stops. As a result, the user undesirably uses the timepiece indicating wrong time. As a countermeasure against the above problem, the alarm display is performed by the pulse motor stop memory 9.

Figure 15:
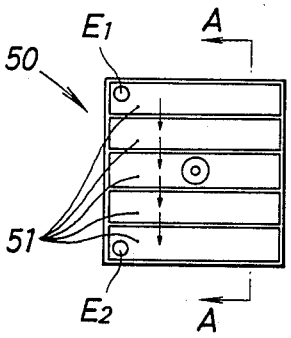
FIG. 15 is a plan view of a solar cell unit in the solar cell electronic timepiece according to the present invention.
Figure 16:
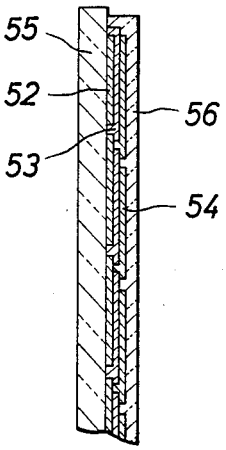
FIG. 16 is a sectional view taken along the line A—A in FIG. 14.

In the first and second embodiments, the solar cell unit 50 is arranged such that 5 rectangular solar cell segments 51 are aligned so as to be electrically connected in series with each other, as shown in FIG. 15. FIG. 16 is a sectional view taken along the line A—A of FIG. 15. As is apparent from FIG. 16, the solar cell unit 50 is obtained by depositing a plurality of transparent electrodes 52 on a glass substrate 55 to be slightly separated from each other, stacking amorphous silicon solar cells 53 on the respective transparent electrodes 52 in a band-like manner to be separated from each other and to slightly overlap the adjacent transparent electrodes 52, and stacking metal electrodes 54 on the amorphous silicon solar cells 53 to slightly overlap the adjacent amorphous silicon solar cells 53. Finally, in order to protect the solar cell unit, a protective resin coating 56 is printed on the metal electrodes 54. With this arrangement of the solar cell unit 50, the respective segments are connected in series from one electrode E1 to the other electrode E2.

Since the maximum output voltage of each solar cell segment is 0.5 V, a total output voltage of the solar cell unit 50 consisting of 5 segments as shown in FIG. 15 is about 3 V. On the other hand, since the withstand voltage of a capacitor with a large capacitance connected in parallel with the solar cell unit is about 2.7 V, an output voltage of the solar cell unit of 2.7 V or more is required to completely charge the capacitor.

Figure 17:
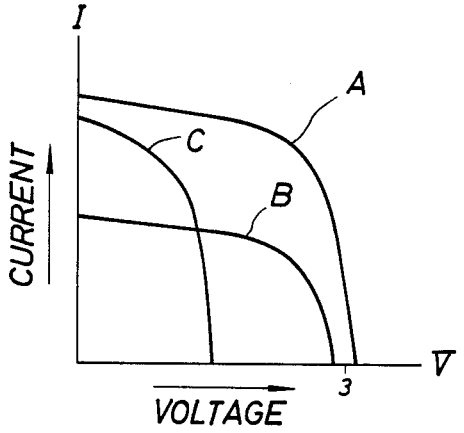
FIG. 17 is a graph showing an output characteristic of the solar cell unit of the solar cell electronic timepiece according to the present invention.
Figure 18:
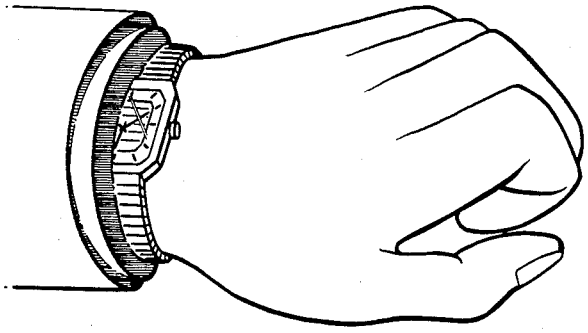
FIG. 18 is a view showing how the solar cell electronic timepiece according to the present invention is carried.

FIG. 17 is a graph of an output characteristic of the solar cell unit, in which the axis of abscissa indicates an output voltage, and the axis of ordinate indicates an output current.

In FIG. 17, a characteristic A indicates an output obtained in a case in which the entire light-receiving surface of the solar cell unit is irradiated with light and generates the maximum photovoltaic voltage. In this case, a voltage of 3 V or more, which is required to completely charge the capacitor with a large capacitance, can be obtained. A characteristic B indicates an output obtained in a case in which a right half of the solar cell segment area is covered with a sleeve of a cloth. In this case, although a current value is as half that of the characteristic A, a maximum output voltage of about 3 V or more can be obtained. Therefore, the capacitor with a large capacitance can be completely charged. On the contrary, a characteristic C indicates an output obtained in a case in which an upper or lower half of the solar cell segment area is covered. In this case, the maximum output voltage is reduced to about half although the current value remains substantially the same, so that the capacitor with a large capacitance cannot be completely charged.

As described above, a plurality of longitudinal solar cell segments, which constitute the solar cell unit, are aligned parallel to each other to extend along 3 to 9 o'clock direction of the timepiece so as to be electrically connected in series with each other. Therefore, even if part of the light-receiving surface of the solar cell unit is covered with a sleeve, a sufficient power supply voltage can be obtained for a long period of time to guarantee quality.

In the above embodiments, the analog solar cell electronic timepiece has been described. However, the present invention is not limited to the analog solar cell electronic timepiece but can be applied to a digital electronic timepiece. In this case, an alarm display may be performed by an on-and-off operation of characters which indicate time, and a cycle of an on-and-off operation may be changed between the first modulated signal indicating reduction in the power supply voltage and the second modulated signal indicating that the timepiece is indicating wrong time.

What is claimed is:

1. An electronic timepiece, including a base reference signal generator for generating a base reference signal, a time display device, a capacitor power storage means, and a photovoltaic means for charging said capacitor, characterized by:

a first modulated signal generator for generating a first modulated signal to drive said time display to indicate that said capacitor needs to be charged, a second modulated signal generator for generating a second modulated signal to drive said time display to indicate that said base reference signal generator has stopped, a voltage detector for generating a low voltage signal in response to a low voltage output of said capacitor power storage means, detector means for detecting that the signal from said base reference signal generator has stopped and for generating and storing a stop signal indicating that the base reference signal has stopped, a signal selector for selecting and supplying to said display device the first modulated signal when said low voltage signal is present and for selecting and supplying to said display device said second modulated signal when said stop signal is present.

2. A timepiece according to claim 1, wherein said time display device includes a pulse motor and a hand display device which is driven by said pulse motor, and said display driver is a motor driver for driving said pulse motor.

3. A timepiece according to claim 1, wherein said signal selector has priority to select the second modulated signal when the voltage reduction and oscillation stop detection signals are output at the same time.

4. A timepiece according to claim 2, further comprising a pulse motor stop memory for outputting a pulse motor stop signal and storing the condition of the stop of the pulse motor upon detection of the stop of said pulse motor, and wherein said signal selector selects the second modualted signal when the pulse motor stop signal is output.

5. A timepiece according to claim 1, wherein said reference signal stop memory is reset by an operation signal output from said external operation member.

6. A timepiece according to claim 4, wherein said pulse motor stop memory is reset by an operation signal output from said external operation member.

7. A timepiece according to claim 1, wherein said reference signal stop memory comprises a stop detection circuit including a capacitor charged in accordance with a reference operation signal output from said reference signal generator and a resistor for discharging an electric charge of said capacitor, and a memory circuit for storing the oscillation stop of the reference signal in accordance with the charged voltage of said capacitor.

8. A timepiece according to claim 2, wherein the second modulated signal consists of a drive signal having at least two different modulation periods.

* * * * *